United States Patent [19]

Kehoe

[11] Patent Number: 4,542,776

[45] Date of Patent: Sep. 24, 1985

[54] METHOD AND APPARATUS FOR MANUFACTURING SPLINED CORNER JOINTS

[76] Inventor: Lawrence C. Kehoe, Box 1920, Vineyard Haven, Mass. 02568

[21] Appl. No.: 618,833

[22] Filed: Jun. 8, 1984

[51] Int. Cl.[4] ..... B27F 1/08; B27F 5/02

[52] U.S. Cl. ..... 144/353; 144/355; 144/87; 144/144 R; 409/225; 409/178; 269/41

[58] Field of Search ..... 144/87, 144 R, 353, 144/354, 355, 372; 269/41, 42, 87.2, 112, 902; 33/185 R; 409/225, 178

[56] References Cited

U.S. PATENT DOCUMENTS 187,962 3/1877 Cantrell ..... 144/354

4,369,957 1/1983 Williams ..... 269/902

4,407,344 10/1983 Dicke ..... 144/87

*Primary Examiner*—Francis S. Husar

*Assistant Examiner*—Jorji M. Griffin

*Attorney, Agent, or Firm*—Steele, Gould & Fried

[57] ABSTRACT

A fixture and method for manufacturing corner joints wherein two workpieces having mitered edges are joined to form a corner axis. The workpieces are clamped underneath a table having a plurality of parallel finger slots so that the corner axis is perpendicular to the lengthwise axis of the linger joints. A router is guided through the finger slots to cut aligned slots in mitered edges of the workpieces. A spline is received in the slots to lock the workpieces together.

14 Claims, 10 Drawing Figures

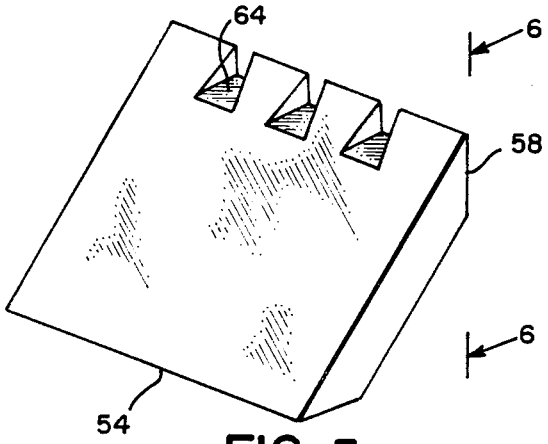
FIG. 5
FIG. 6
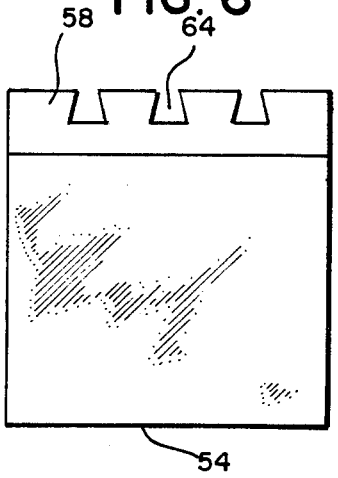
FIG. 7
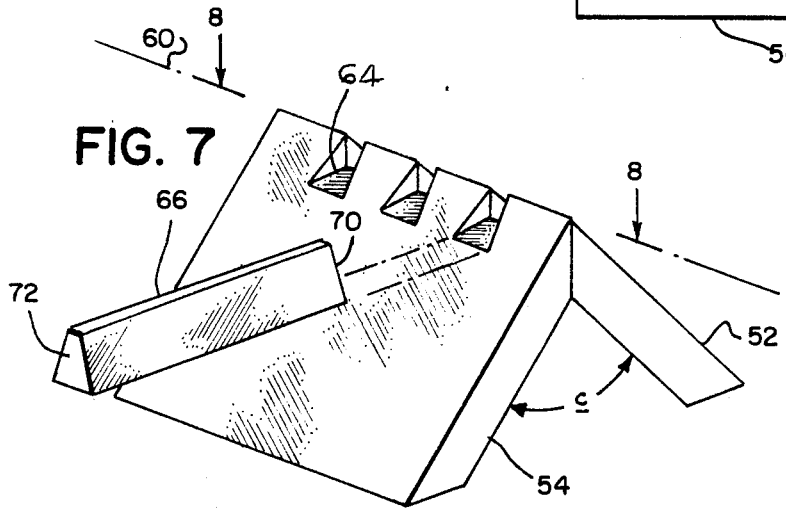
FIG. 8
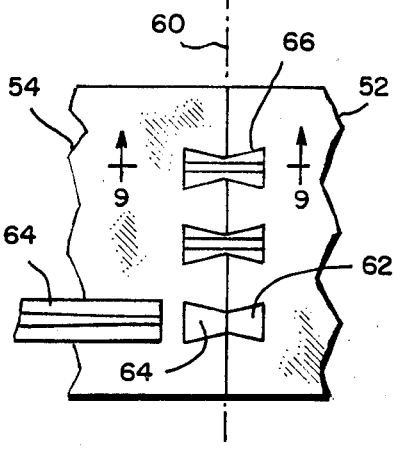
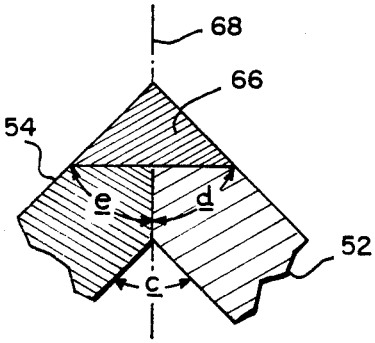
FIG. 9

METHOD AND APPARATUS FOR MANUFACTURING SPLINED CORNER JOINTS

BACKGROUND OF THE INVENTION

1. Field of the Invention

This invention relates generally to the field of manufacturing corner joints, and in particular, to methods and apparatus for manufacturing splined corner joints with a novel fixture for holding workpieces and guiding a routing tool or the like.

2. Prior Art

Corner joints in wood structures have often been manufactured with interlocking structure of one sort or another formed integrally with the edges of the workpieces to be joined. Perhaps the most popular of such joints, as well as the most attractive, is the dovetail joint. Dovetail joints can be particularly difficult to manufacture, as the end of one workpiece must be provided with dovetail-shaped projection, whereas the end of the another workpiece must be provided with slots of corresponding cross-section. Moreover, the mating projections and slots must be precisely aligned with respect to the sides or lateral edges of the workpieces.

Fixtures for manufacturing dovetail corner joints in particular, and other kinds of joints in general, are known in the art. It is common for such fixtures to include guide slots formed by various structure for guidably supporting a routing tool or the like, such tools being used to cut out the projections and the slots. In each instance, however, separate fixtures, or portions of fixtures or sets of guide slots must be utilized for each workpiece. In other words, a first set of guide slots and accompanying workpiece clamping means are used to form the end with the projections, and another set of guide slots and clamping means, different than the first set, is used to form slots in the end of the other workpiece. Examples of such fixtures may be found in the following U.S. Pat. Nos.: 2,764,191; 3,109,466; 3,878,875; 3,604,484; 3,606,916; 4,163,465; 4,168,730; and, 4,405,004.

The method and apparatus for manufacturing corner joints taught herein overcomes all of the difficulties encountered in the prior art methods and apparatus. Firstly, corner joints are held together primarily by splines, that is, separate wedge-shaped members which fit into corresponding slots in both edges of the workpieces to be joined together. Although this invention preferably utilizes a worktable having a plurality of substantially parallel finger slots therethrough for guidably supporting a routing tool or the like on one surface thereof, it is the first such apparatus which provides clamping means disposed on the other surface of the worktable for receiving and holding both workpieces simultaneously, wherein mitered edges of the workpieces to be joined together are held against one another in that very orientation which is desired for the final product. In other words, the workpieces are clamped together in a predetermined alignment relative to one another in a completed or finished orientation during formation of the grooves. Accordingly, when the workpieces are removed from the fixture for permanent attachment to one another, they automatically align perfectly with one another. Splines of a cross-section corresponding to that of the slots, can then be slidably inserted into the slots, locking the workpieces together. The joint can be finished by cutting unnecessary portions of the spline, and then filing and sanding the exposed ends thereof to be flushed and smooth with the surfaces of the workpieces. Such corner joints can be easily made with a dovetail configuration, or alternatively, with almost any cross-section, limited only by the available shapes of the cutting blades of routing tools and the like.

The corner joint which is produced according to this invention is very strong, automatically and precisely aligned and quite attractive. Corner joints according to this invention are also considerably easier and faster to manufacture, thereby reducing costs.

SUMMARY OF THE INVENTION

It is an object of this invention to provide methods and apparatus for manufacturing corner joints.

It is another object of this invention to provide methods and apparatus for manufacturing splined corner joints.

It is still another object of this invention to provide methods and apparatus for manufacturing splined corner joints with greater precision and at lower cost than has been possible.

It is yet another object of this invention to provide a novel worktable and associated clamping means to hold workpieces in a fixed, finished orientation during manufacture of splined corner joints.

It is yet a further object of this invention to provide methods and apparatus for manufacturing splined corner joints which simulate the appearance of existing joint configurations in general, and dovetail configurations in particular.

These and other objects are accomplished by an apparatus for manufacturing splined corner joints, comprising: a worktable having a plurality of substantially parallel finger slots with parallel or non-parallel sidewalls for guidably supporting a routing tool on one surface thereof, the cutting blade of the routing tool projecting through the slots during use; and, clamping means disposed on the other surface of the worktable for receiving and holding two workpieces having mitered edges to be joined together against one another such that the mitered edges abut one another to form an angle about a corner axis, the corner axis being substantially perpendicular to the lengthwise axes of the finger slots, whereby guided movement of the router through the finger slots automatically provides sets of aligned slots in both mitered edges for receiving connecting splines of corresponding cross-section which lock the workpieces together in precise alignment.

These and other objects are also accomplished by a method for manufacturing splined corner joints on a worktable having a plurality of parallel finger slots therethrough for guided movement of a routing tool on one side thereof, comprising the steps of: mitering abutment edges on two workpieces to be joined as a corner; clamping the mitered edges of the workpieces together, in operable relationship to the other side of the worktable, such that the mitered edges abut on another to form an angle about a corner axis substantially perpendicular to the lengthwise axes of the finger slots; cutting sets of aligned slots in both mitered edges by moving a cutting blade along the finger slots from the first side thereof; and, inserting splines into the aligned slots of the mitered edges, the splines having a cross-section corresponding to that of the slots, whereby the splines lock the workpieces together in precise alignment. It will be noted that the mitered edges of the workpieces could be glued prior to clamping to provide an extremely strong joint.

In the presently preferred embodiment, the clamping means are arranged to receive workpieces disposed substantially perpendicularly to one another, each having a mitered edge bevelled at an angle of approximately forty five degrees. In this orientation, the mitered edges together define an abutment plane which is substantially perpendicular to both the lengthwise axes of the finger slots and a plane defined by the worktable.

BRIEF DESCRIPTION OF THE DRAWINGS

For the purpose of illustrating the invention, there are shown in the drawings forms which are presently preferred; it being understood, however, that this invention is not limited to the precise arrangements and instrumentality shown.

FIG. 5 is a perspective view of a workpiece which has been slotted in the apparatus shown in FIGS. 1–4.

FIG. 6 is an end view taken along the line 6—6 in FIG. 5.

FIG. 7 is a perspective view of two workpieces being joined together by splines to form a corner joint according to this invention.

FIG. 8 is a plan view taken along the line 8—8 in FIG. 7.

FIG. 9 is a section view taken along the line 9—9 in FIG. 8.

Directional orientations such as upper, lower, left and right are used in describing the invention in conjunction with the drawings. Such directional orientations are used solely for purposes of convenience, and are not to be deemed to limit the scope of the invention.

DETAILED DESCRIPTION OF THE PREFERRED EMBODIMENTS

Figure 1:
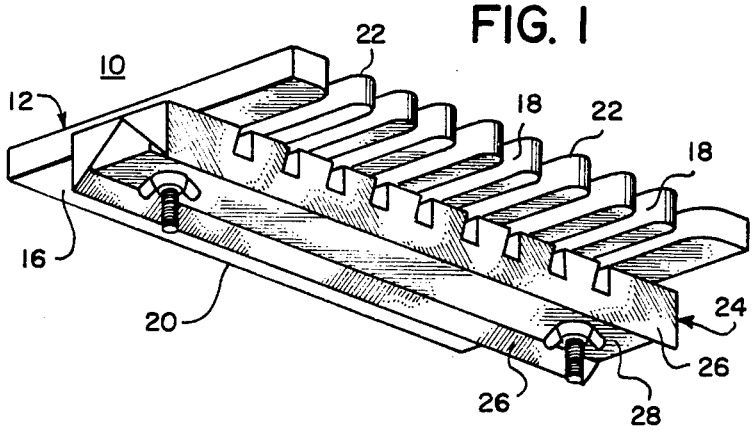
FIG. 1 is a perspective view, from below, of an apparatus according to this invention for manufacturing splined corner joints.

An apparatus 10 for manufacturing splined corner joints according to this invention comprises a worktable 12 shown in FIG. 1. The worktable 12 has an upper side or surface 14 and lower side or surface 16. The worktable may be thought of as defining, or lying in a plane which is parallel to the upper and lower surfaces 14 and 16. The worktable has a plurality of finger slots 18 therethrough, defined by a worktable structure including a base member 20 and a plurality of finger-like projections 22 exteding outwardly from the base 20 in the plane of the worktable. The finger slots 18 have substantially parallel, lenghtwise axes lying in the worktable plane, parallel to the finger-like projections 22 and perpendicular to the base member 20.

Figure 3:
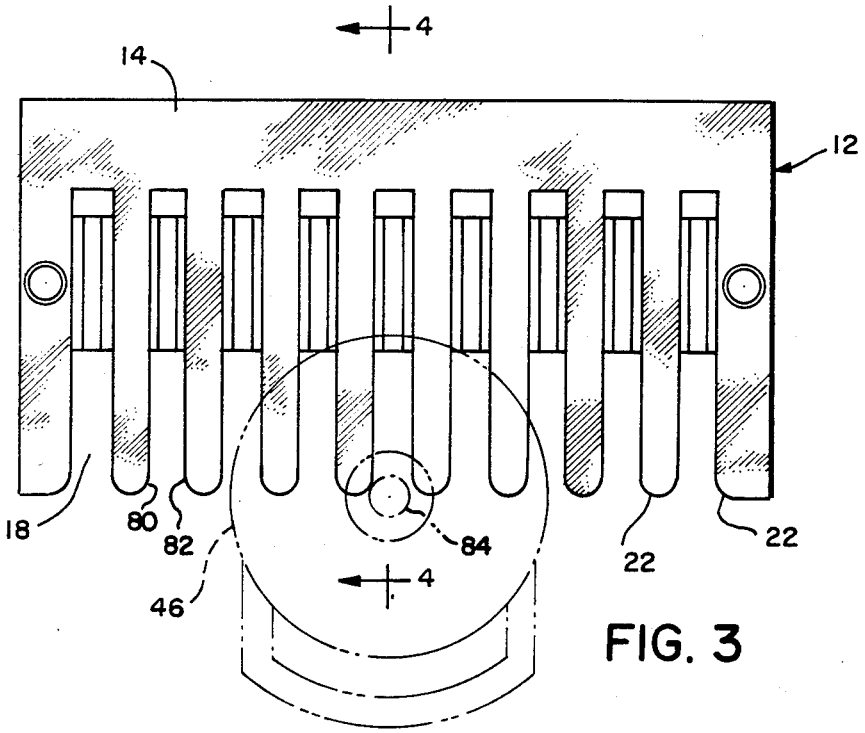
FIG. 3 is a top plan view of the apparatus shown in FIG. 1, a routing tool being shown in phantom.

The finger slots 18 are intended to provide guideways or paths for controlling movement of a hand-held routing tool or the like. Structure of the routing tool rests on the upper surface 14, in such a way that a cutting blade extends through the finger slots perpendicularly to the plane of the worktable. The free ends of the finger-like projections 22 are preferably rounded in order to facilitate insertion of the cutting blade and its mounting shaft into the finger slots 18. While the slots 18 are illustrated in FIG. 3 as being defined between parallel walls 80,82, it should be noted that the slots could also be defined between non-parallel walls. Thus, if the slots 18 were tapered wide at one end and narrow at the other, the routing tool 48 could be guided to cut a tapered slot in the workpieces in a manner whereby a similarly tapered spline would always fit snugly when inserted into the slot. It would also be possible to alternate the wide and narrow ends of adjacent worktable slots whereby alternately configured slots could be cut in the workpieces.

A clamping means 24 is disposed on the lower surface 16 of the worktable 12. The clamping means 24 comprises two cradle member halves 26 which extend lengthwise perpendicularly to the lengthwise axes of the finger slots 18. The cradle member halves 26 have a triangular cross-section and are arranged in such a way that the hypotenuse of each triangular cross-section forms a workpiece receiving surface 30 of the clamping means 24. In the illustrated embodiment, cradle member halves 26 are fixed directly to the lower surface 16 of the worktable 12, by adhesive and screw means.

Figure 2:
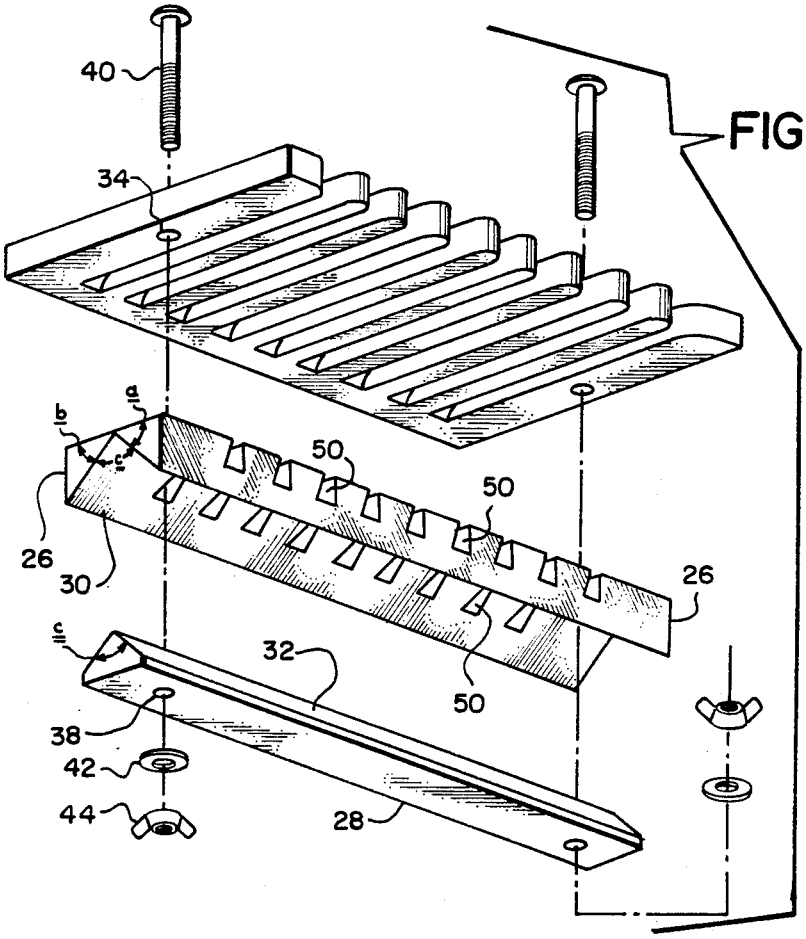
FIG. 2 is an exploded view of the apparatus shown in FIG. 1.

A clamping bar 28 has a triangular cross-section defining two workpiece clamping surfaces 32 which are designed to seat parallel to clamping surfaces 30 of the cradle member halves 26. Clamping bar 28 is approximately as long as the cradle member halves 26, and has a lengthwise axis parallel thereto. Clamping bar 28 is removably attachable by means of bores 34 in the worktable 12, corresponding bores in cradle member halves 26, and bores 38 in clamping bar 28. In order to facilitate manual attachment and removal of clamping bar 28, it is attachable by means of bolts 40, washers 42 and wing nuts 44. In the presently preferred embodiment, the apparatus is constructed for the manufacture of right angle joints, wherein the ends of workpieces are preferable mitered at angles of 45°. With reference to FIG. 2, angles a and b are each approximately 45°. Angle c is approximately 90°. If angles having smaller joints were necessary, then angles a and b would be less than 45°, and angle c would be greater than 90°. The converse would be true for corner angles greater than 90°.

The worktable 12 may be supported in any convenient fashion which does not interfere with workpieces held in the clamping means and extending downwardly and outwardly therefrom, or with a routing tool 46 or the like resting on the upper surface of the worktable. Such support means are conventional, and do not form a part of this invention. As illustrated in the drawings, the clamping means 26 is affixed directly to the lower surface of the worktable. In most instances, this is expected to be the most convenient construction. However, it is certainly possible for the worktable 12 and the clamping means 24 to each be separately mounted to an independent structural support of some sort, so long as they could be brought into an operable relationship immediately adjacent one another. Where the clamping means 24 are permanently affixed, further operation will be enhanced if slots 50 are first cut out of the cradle member halves 26. Removable cradle halves, or those made for different angles, should also be pre-cut. Uncut members might be preferable for those intending manufacture of corner joints with splines of unusual cross-section.

The worktable 12 may be easily constructed from wood, and is so illustrated in the drawings. Interconnection of the worktable 12 and the clamping means 24 can be by a combination of wood glue and wood screws. It is of course possible to construct the apparatus from metal and/or sufficiently strong plastic members. A combination of such materials might very well prove most efficient in terms of construction costs and durability. It is also within the scope of this invention to provide removably attachable clamping means 24, so that corner joints of different corner angles can be manufactured. A different clamping bar 28 would of course be provided for each clamping means 24. Moreover, it is also within the scope of this invention to provide adjustable clamping means and adjustable clamping bars which could be set to a plurality of different angles.

Figure 4A:
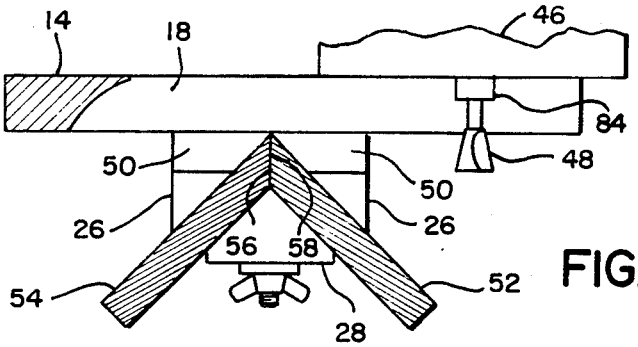
FIG. 4A is section view taken along the line 4—4 in FIG. 3.
Figure 4B:
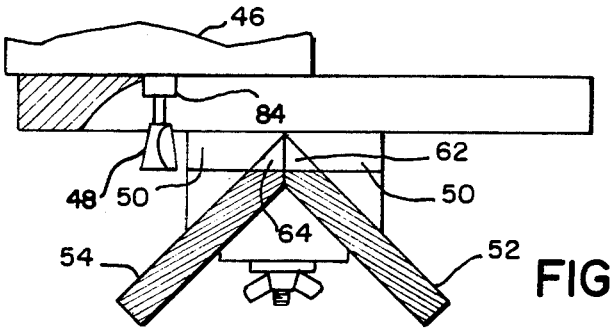
FIG. 4B is a section view identical to FIG. 4*a*, except that the routing tool has been moved to the left, performing a routing operation during movement.

Use of the apparatus 10 is fully illustrated in FIGS. 3, 4A and 4B. A routing tool 46 is supported on the upper surface 14 of worktable 12. A cutting blade 48 extends through one of the finger-slots 18 defined by the finger-like projections 22 in a usual manner whereby the router guide or bearing 84 can serve to guide the router during the cutting operations by bearing against or guiding upon the opposed walls 80,82 which define each slot 18 as above set forth, the walls 80,82 may or may not be parallel. Workpieces 52 nd 54 are held in clamping means 24. The workpieces 52 and 54 have been first provided with bevelled abutment edges 56 and 58 respectively. As illustrated, the bevelled edges are formed at angles of 45°, defining a corner angle of 90°. Each of workpieces 52 and 54 is pressably held between a clamping surface 32 of the clamping bar 28 and a clamping surface 30 of a cradle member half 26. The bevelled edges 56 and 58 are abutted firmly against one another. Clamping pressure is provided by the bolt and wing nut assemblies. If desired, the bevelled edges of the workpieces may be glued prior to clamping.

With the routing tool in the position of FIG. 4A, the cutting blade 48 is aligned to pass through slots 50 in the cradle member halves 26. The bevelled edges of the workpieces 52 and 54 project between the slots 50 of the two cradle member halves.

The upper and outermost edges of the two workpieces abut one another, and abut the bottom surface 16 of the worktable 12 at an intersection of points defining a line referred to hereinafter as the corner axis 60 (see FIGS. 7 and 8). This corner axis is perpendicular to the lengthwise axes of the finger slots 18. The abutting surfaces of bevelled edges 56 and 58 intersect at a plurality of points defining an abutment plane 68, hereinafter referred to as the joint plane (see FIGS. 7 and 9). In the embodiment and arrangement shown in FIGS. 4A and 4B, the joint plane 68 is perpendicular to the lengthwise axes of the finger slots 18 and is also perpendicular to the plane defined by the worktable 12.

In moving from FIG. 4A to FIG. 4B, the routing tool 46 and cutting blade 48 have passed through slots 50, and at the same time, through the abutted edges of the workpieces, forming a configured slot 62 in the end of workpiece 52 and configured slot 64 in the end of workpiece 54. The routing tool can be moved through as many of the finger slots 18 as is necessary to provide sets of aligned slots in both mitered edges, as shown in FIGS. 5–9. In this embodiment, the slots are of a dovetail configuration, provided by an appropriately shaped cutting blade 48. Of course, some judgment must be exercised in alignably clamping the workpieces so that the sets of aligned, configured slots are equally spaced along the bevelled edges.

The slotted workpiece 54 is shown in FIG. 5. The bevelled end 58 has a plurality of configured, dovetail-shaped slots 64 therethrough. When workpieces 52 and 54 are realigned as shown in FIG. 7, with edges 56 and 58 abutting one another, a plurality of splines 66 of corresponding cross-section to the configuration of the slots 62 and 64 can be slidably inserted, locking the workpieces together at the desired corner angle c with respect to corner axis 60. The splines 66 may be tapered slightly from a narrower end 70 to a wider end 72, facilitating initial insertion, and then assuring a firmly locked joint.

Portions of the spline 66 which extend beyond the respective surfaces of workpieces 52 and 54 can be removed by cutting, filing and then sanding. When finished, the ends of the splines will be smooth and flush with the respective surfaces of the workpieces. Although the splines will firmly lock the workpieces together, it is recommended that the joints and splines also be glued to one another as is the conventional practice in wood construction.

With reference to FIG. 9, The embodiment of the invention illustrated in the drawings assumes that the angle d in workpiece 52 and the angle e in workpiece 54 will both be 45°, defining a corner angle c, about corner axis 60, of 90°. In this instance, the abutment or joint plane 68 is perpendicular to the plane of the worktable 12 when the workpieces are held in the clamping means 24. It will be appreciated by those skilled in the art that angles d and e need not be 45°, need not be equal to one another and need not necessarily total 90°. If there is any variation between angles d and e then joint plane 68 will not be perpendicular to the plane of the worktable 12. The corner axis 60 will always be perpendicular to the lengthwise axes of the finger slots, and the joint plane 68 will always intersect fully corner axis 60. It will be appreciated by those skilled in the art that the invention is operable within a wide range of angular orientations and relative thicknesses of workpieces 52 and 54.

If the corner joint to be manufactured is longer than the fixture an easy procedure is available to deal with the problem. A first set of slots can be made according to the usual procedure. The workpieces can be removed, and then temporarily attached by a spline. Insertion of the spline automatically aligns the workpieces, which can then be reinserted into the clamping means in a different position to cut further slots.

This invention may be embodied in other specific forms without departing from the spirit or essential attributes thereof. Accordingly, reference should be made to the appended claims, rather than to the foregoing specification, as indicating the scope of the invention.

What is claimed is:

1. An apparatus for manufacturing splined corner joints, comprising:

a worktable having a plurality of adjacent finger slots therethrough for guidably supporting a routing tool and the like on a first side thereof, the cutting blade of the routing tool projecting through the slots during use; and, clamping means on the other side of the worktable for receiving and holding two workpieces, having mitered edges to be joined against one another, such that the mitered edges abut one another to form a desired angle about a corner axis, the corner axis being substantially perpendicular to the lengthwise axes of the finger slots, whereby guided movement of the router through the finger slots automatically provides sets of aligned slots in both mitered edges for receiving connecting splines of corresponding cross-section which lock the workpieces together in precise alignment.

2. An apparatus according to claim 1, wherein the clamping means comprises a cradle extending lengthwise perpendicularly to the lengthwise axes of the finger slots and having clamping surfaces for receiving the workpieces; and, a clamping bar of a shape corresponding to the cradle for engaging opposite surfaces of the workpieces and pressably holding the workpieces in the cradle.

3. An apparatus according to claim 2, wherein the cradle comprises two members of triangular cross-section, the hypotenuse of each forming a clamping surface.

4. An apparatus according to claim 1 wherein the finger slots are substantially parallel.

5. A method for manufacturing splined corner joints on a worktable having a plurality of substantially parallel finger slots therethrough for guided movement of a routing tool and the like, comprising the steps of;

mitering abutment edges on the two workpieces to be joined as a corner;

clamping the mitered edges of the workpieces together, in operable relationship to the worktable, such that a corner axis defined by the mitered edges is perpendicular to the lengthwise axes of the finger slots;

cutting sets of aligned slots in both mitered edges by moving the cutting blade of the routing tool along the finger slots on the other surface of the worktable; and, inserting splines into the aligned slots of the mitered edges, the splines having a cross-section corresponding to that of the slots, whereby the splines lock the workpieces together in precise alignment.

6. A method according to claim 5, further comprising the step of tapering the splines prior to insertion into the slots.

7. A method according to claim 5, further comprising the step of gluing the splines within the slots.

8. A method according to claim 5, further comprising the step of securing a first workpiece below the worktable and defining an angle of less than ninety degrees between the plane of the worktable and the workpiece.

9. A method according to claim 8, further comprising the step of securing a second workpiece below the worktable in ninety degree relationship to the said first workpiece.

10. A method according to claim 5 wherein the clamping comprises gluing the mitered edges.

11. A method of manufacturing splined corner joints, comprising the steps of;

mitering abutment edges on the two workpieces to be joined as a corner, defining an included angle, relative to a corner axis;

clamping the mitered edges together such that the workpieces assume the included angle;

cutting sets of aligned slots through both mitered edges by moving a cutting blade of predetermined cross-section through the mitered edges of the workpieces, perpendicularly to the corner axis; and, inserting splines into the aligned slots of the mitered edges, the splines having a cross-section corresponding to that of the slots, whereby the splines lock the workpieces together in precise alignment.

12. A method according to claim 11, further comprising the step of tapering the splines prior to insertion into the slots.

13. A method according to claim 11, further comprising the step of spacing the cut sets of aligned slots equidistantly.

14. A splined corner joint manufactured in accordance with the method of claim 11.

* * * * *